United States Patent [19]

Takenoya et al.

[11] Patent Number: 4,697,941

[45] Date of Patent: Oct. 6, 1987

[54] PLATEN AND PAPER DRIVE IN AN INKED-PLATEN WIRE-DOT IMPACT PRINTER

[75] Inventors: Hideaki Takenoya, Hachioji; Fumiyuki Mishima, Hino, both of Japan

[73] Assignee: Janome Sewing Machine Industry Co., Ltd., Japan

[21] Appl. No.: 850,084

[22] Filed: Apr. 9, 1986

Related U.S. Application Data

[63] Continuation of Ser. No. 617,783, Jun. 6, 1984, abandoned.

[30] Foreign Application Priority Data

Jun. 7, 1983 [JP] Japan ..... 58-100230
Jun. 8, 1983 [JP] Japan ..... 58-86411[U]

[51] Int. Cl.[4] ..... B41J 27/08

[52] U.S. Cl. ..... 400/185; 400/470; 400/616; 400/649; 400/662

[58] Field of Search ..... 400/124, 185, 470, 471, 400/471.1, 511.2, 511.3, 511.4, 516, 518.4, 616, 616.1, 616.2, 616.3, 649, 657, 662

[56] References Cited

U.S. PATENT DOCUMENTS

| | | | |
|---|---|---|---|
| 2,214,415 | 9/1940 | Kittel | 400/649 |
| 2,858,927 | 11/1958 | Metzner et al. | 400/662 |
| 4,160,606 | 7/1979 | Caenazzo | 400/616.2 |
| 4,376,585 | 3/1983 | Fromme et al. | 400/185 |
| 4,538,932 | 9/1985 | Takenoya et al. | 400/662 |
| 4,556,333 | 12/1985 | Stefansson | 400/662 |
| 4,611,940 | 9/1986 | Takenoya et al. | 400/649 |

FOREIGN PATENT DOCUMENTS

| | | | |
|---|---|---|---|
| 56-33972 | 4/1981 | Japan | 400/662 |
| 57-12667 | 1/1982 | Japan | 400/470 |
| 57-131588 | 8/1982 | Japan | 400/124 |

OTHER PUBLICATIONS

*IBM Tech. Disc. Bull.*, Humphreys, "Color Wheel w/Inlaid Platens"; vol. 25, No. 4, p. 2193; Sep. 1982.

*Primary Examiner*—Edgar S. Burr
*Assistant Examiner*—David A. Wiecking
*Attorney, Agent, or Firm*—William A. Drucker

[57] ABSTRACT

In a wire-dot impact type printer a cylindrical platen and a printing paper are rotated or transported at the same rate, by connecting them to a single and common electric motor through a first and second transmission mechanisms, respectively. The first transmission mechanism directly connects the platen to the motor to cause the former to rotate together with rotation of the latter in any direction, whereas the second transmission mechanism includes a clutch composed of a first and a second members rotatable about a common center axis but separately from each other in which the first member is caused to rotate together with rotation of the motor in any direction while the second member is caused to rotate together with the first member being rotated in one direction but prevented from rotating when the first member is rotated in the other direction. In the latter case the platen is rotated for color changing operation, but the printing paper is prevented from running through the printer.

2 Claims, 3 Drawing Figures

PLATEN AND PAPER DRIVE IN AN INKED-PLATEN WIRE-DOT IMPACT PRINTER

This application is a continuation, of application Ser. No. 617,783, filed June 6, 1984, now abandoned.

BACKGROUND OF THE INVENTION

This invention relates to a printing machine in general and more particularly to a printer of a wire-dot impact type.

There have been proposed a printer of a type wherein a printing paper is passed between a printing head and a platen having a plurality of sintered members saturated with different color inks mounted on the periphery thereof, and the paper is pressed against a selective one of the ink saturated members by means of wires in the printing head, so that a color print may be effected. According to the prior art, an electric motor or the like has been employed for rotating the platen to thereby select a desired one of colors to be printed on the paper, in addition to two motors for transporting the printing head and the paper, respectively, resulting in increase in the size of the printer as well as in complexity of the individual drive motors.

Moreover, when a relative position is changed between the platen and the printing paper, the paper may touch the platen and thus be contaminated by the ink saturated members of the platen, especially when the paper is displaced relative to the platen, because the paper will be often slackened or skipped while being transported with respect to the platen. In this connection it is to be noted that the platen is caused to rotate for color changing operation, but at this time the paper is stopped from running while the platen is simply rotated around a predetermined center axis. Therefore there is little probability of the paper being contaminated by ink. Thus, the paper contamination will become serious at the time of feeding paper, especially at the time of changing the line to be printed.

SUMMARY OF THE INVENTION

Accordingly the present invention has been provided to eliminate defects and disadvantages of the prior art printer.

It is an object of the invention to provide a novel wire-dot impact type printer, simple in construction and easy to operate.

Another object of the invention is to provide a novel driving mechanism used in combination with a wire-dot impact type printer, by which both of the paper feed operation and color changing operation can be controlled by a single driving motor.

Still another object of the invention is to prevent a printing paper from being contaminated by an ink saturated platen during the printing operation.

According to the invention there is provided a printer comprising a rotary platen having a plurality of members saturated with different color inks provided on a periphery thereof; a printing head arranged opposite to the platen so as to cooperate with the platen to apply an ink of a specific color to a printing paper adapted to pass therebetween; first means for rotating the platen; second means for transporting the printing paper relative to the platen and the printing head; a single drive means for driving the first and second means; first transmission means operatively connecting the first means to the single drive means; and second transmission means operatively connecting the second means to the single drive means, the second transmission means including a clutch for selectively transmitting the driving force of the single drive means to the second means.

BRIEF DESCRIPTION OF THE DRAWINGS

The foregoing and further objects and advantages of the invention can be fully understood from the following detailed description when read in conjunction with the accompanying drawings in which.

PREFERRED EMBODIMENT OF THE INVENTION

Figure 1:
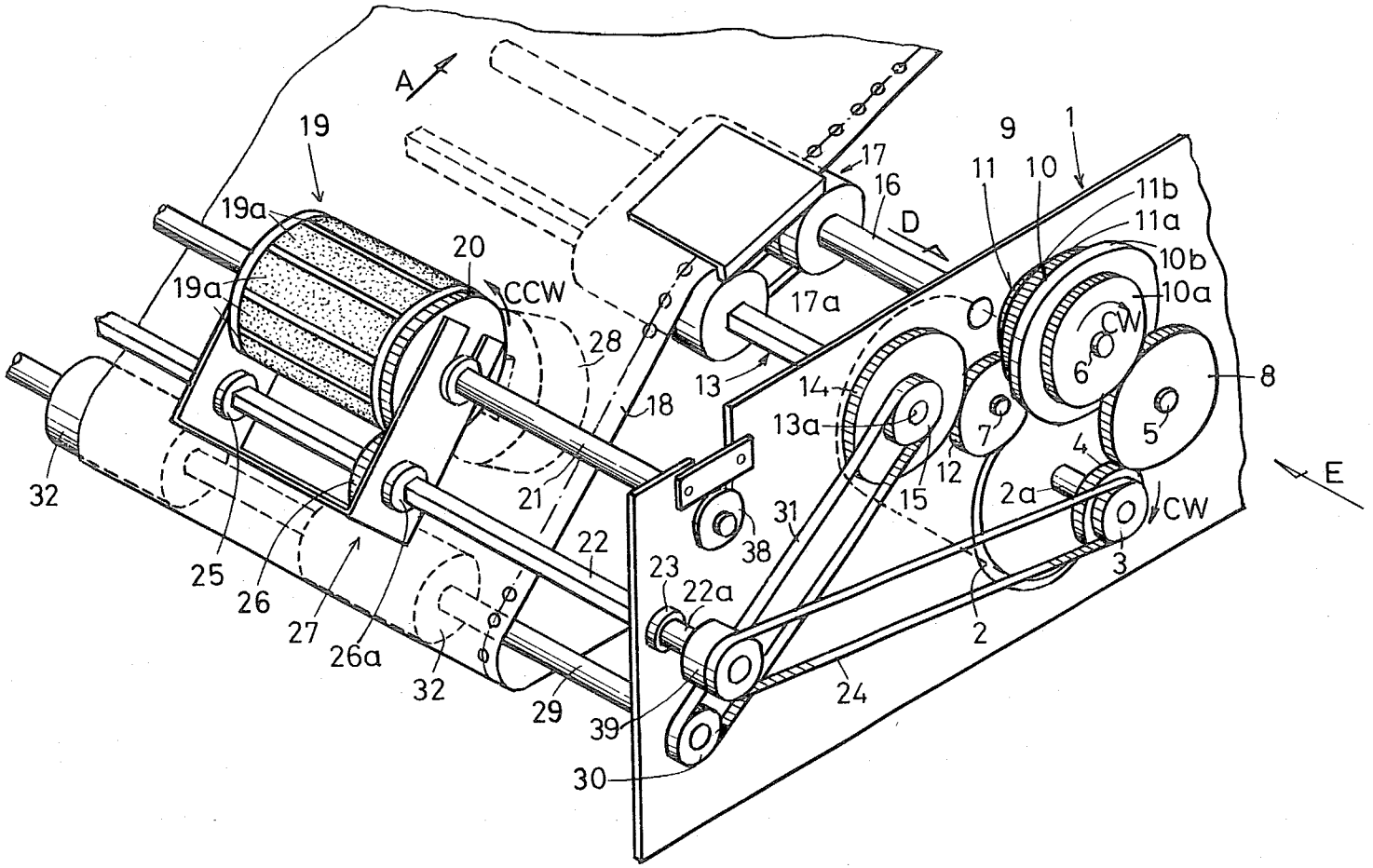
FIG. 1 is a perspective view diagrammatically showing a structure of principal elements of a printer embodying the invention.

A preferred embodiment of the invention will now be described in the following, in which directions of rotation and movement of respective parts are defined as being viewed from the right of FIG. 1. In a printer, an electric motor 2 is secured to the inside of a frame 1. The motor 2 has a rotational shaft 2*a*, an end of which will protrude outside the frame 1 and is provided with a pulley 3 and a gear 4 mounted thereon. The numerals 5, 6 and 7 denote pins arranged on the outside of the frame 1, respectively. The pin 5 has a gear 8 rotatably mounted thereon and being in mesh with gear 4 of the motor shaft 2*a*. A one-way rotation clutch 9 is rotatably mounted on the fixed axis 6, which consists of a first rotating unit 10 composed of a gear 10*a* and a disc 10*b* formed coaxially with each other and a second rotation unit 11 composed of a ratchet wheel 11*a* and a gear 11*b*. The gear 10*a* of the first unit 10 engages the gear 8, whereas the gear 11*b* of the second unit 11 is in mesh with another gear 12 which is rotatable about the fixed axis 7. The one-way rotation clutch will be described later in more detail.

A square shaft 13 is rotatably supported between a pair of vertical frames 1, though one of which is illustrated in FIG. 1, and a round shaft 13*a*, which is a part of the shaft 13, extends outside the frame 1 to provide a common shaft for fixedly mounting thereon a pulley 15 and a gear 14 adapted to engage with gear 12.

Extending in parallel with the square shaft 13 is a guide shaft 16 rotatably mounted on the frame 1, and a pair of tractors 17 (only one of which is shown) for feeding a printing paper are mounted on the shafts 13, 16 and are laterally displaceable with respect to the shafts 13, 16 in dependence upon the width of the paper 18. An endless belt 17*a* of each tractor 17 is rotated in the clockwise direction CW due to rotation of the square shaft 13. The endless belt 17*a* is provided with a plurality of pins (not shown) which are engageable with holes 18*a* formed in the paper 18 along the edge thereof so as to feed the paper 18 in the direction of the arrow A.

A cylindrical platen 19 provided at the periphery a plurality of sintered members 19*a* saturated with different color inks, is rotatable and slidable with respect to its axis 21 supported by frame 1 via a bearing 38. A transmission gear 20 is integrally attached to the one side of platen 19.

A second square shaft 22 extends in parallel with the platen shaft 21 and is rotatably supported by frame 1 through its round end portion 22*a* and a bearing 23. The extreme end of the round portion 22*a* is formed a pulley 39 which is connected to the pulley 3 of the motor shaft 2*a* through a belt 24 to transmit the rotational movement of the latter to the platen 19 via a gear 26 of the square shaft 22 and the gear 20 of the platen 19.

A holder 27 is mounted on the square shaft 22 and holds a platen unit of platen 19 and gear 20. The holder 27 is laterally slidable together with the gear 26 having a boss 26*a* connected to the holder 27, to thereby shift the platen 19 laterally along the shaft 21. The printing operation is carried out while the platen 19 and a printing head 28 are laterally transported in the same direction, that is from the left to the right in FIG. 1, but the moving speed of the former should preferably be made a little slower than that of the latter so that a position of platen 19 is gradually changed relative to the printing head 28. More particularly, at the initial leftmost position of platen 19 which is ready for starting the printing operation on a new line of the printing paper 18, the printing head 28 is designed to impact the leftmost part of the platen 19, and the impact part will be gradually shifted toward right as the platen 19 comes to the right until the head 28 will impact the rightmost part of the platen 19 when the platen comes to the rightmost position. This is to effectively use the face of the ink saturated sintered members 19*a* of the platen 19.

A pair of feed rollers 32 are mounted on a shaft 29 which extends in parallel with the shaft 22 and rotatably supported on the panel 1. The shaft 29 has a pulley 30 secured to one end thereof on the outside of the frame 1 and connected to the pulley 15 by a belt 31. Although not shown, a pair of pinch rollers are arranged opposite to the feed rollers 32 respectively so that the paper 18 is adapted to pass therebetween to thereby run in the direction A.

Figure 2:
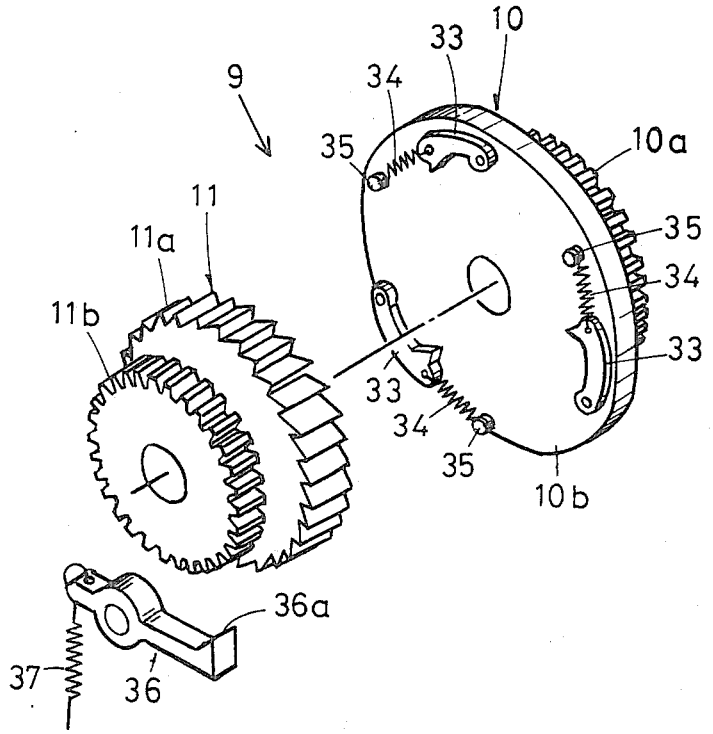
FIG. 2 is a fragmentary perspective view showing a clutch of the printer of FIG. 1, taken in the direction of the arrow D.
Figure 3:
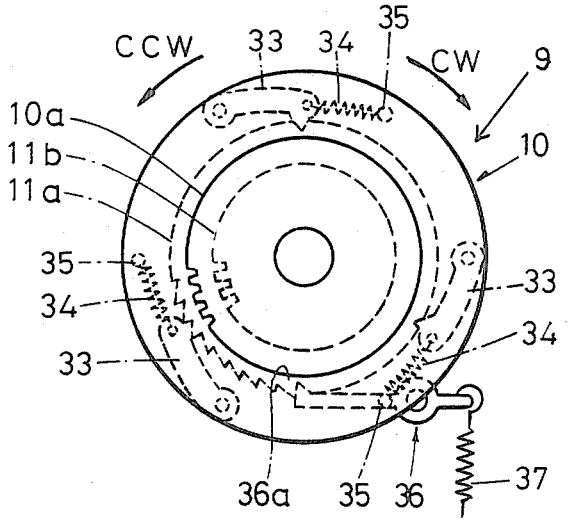
FIG. 3 is an explanatory view showing the clutch taken in the direction of the arrow F of FIG. 1.

Further detail of the one-way rotation clutch 9 will now be described, in reference to FIGS. 2 and 3. As having been described the first and second rotating units 10 and 11 are mounted on the common axis 6 (FIG. 1). The disc 10*b* of the first rotating unit 10 has on one side thereof a number of pawl members 33 each turnably mounted and normally biased by each of tension springs 34 in a direction that the pawl members 33 will engage the teeth of the ratchet wheel 11*a*, the tension springs 34 being each anchored to each of pins 35 planted on the side of the disc 10*b*. A stopper 36 having a pawl 36*a* at one end thereof is turnably mounted on the frame 1 and is normally biased in one direction by a tension spring 37 so that the pawl 36*a* may engage one of the teeth of the ratchet wheel 11*a*. Accordingly, the first rotating unit 10 is rotated in the counterclockwise direction CCW, the pawl members 33 are brought out of engagement with the teeth of the ratchet wheel 11*a* against the action of the tension springs 34. Thus, the first rotating unit 10 may be rotated in the direction CCW, while the second rotating unit 11 remains standstill due to the action of the stopper 36 having the pawl 36*a* brought into engagement with one of the teeth of the ratchet wheel 11*a*. On the other hand, if the first rotating unit 10 is rotated in the clockwise direction CW, the second rotating unit 11 is rotated in the same direction CW due to the action of the pawl members 33 pressed against the teeth of the ratchet wheel 11*a* and because the stopper 36 is turned in the direction away from the teeth of the ratchet wheel 11*a*. Thus, the first and second rotating units 10 and 11 are rotated together.

The operation of the printer of the invention will be described as follows: At first, the operation for controlling the paper feed will now be described which is generally required at the time of printing a new line of the paper, for example. More particularly, the motor shaft 2*a* is rotated in the clockwise direction CW to thereby rotate the first unit 10 of the one-way rotation clutch 9 in the same direction CW through gears 4, 8, 10*a*, which will result in rotation of the second unit 11 in the same direction CW due to the action of the pawl members 33. Then the square shaft 13 is caused to rotate in the clockwise direction CW via gears 11*b*, 12, 14, and the feed rollers 32 will also be rotated in the clockwise direction CW at the same rate with that of tractor 17 through the pulley assembly 15, 31, 30, so that the paper 18 is fed in the direction A by cooperation of tractor 17 and feed roller 32.

Rotation of the motor shaft 2*a* in the clockwise direction CW will simultaneously cause the platen 19 to rotate in the counterclockwise direction CCW via pulley 3, belt 24, pulley 39, square shaft 22 and gears 26, 20.

Thus, the rotation movement utilized for feeding paper 18 and for rotating platen 19 are derived from a single and common source, that is the driving motor 2, resulting in that the relative speed of movement between paper and platen is substantially zero. This is advantageous in preventing contamination of paper, which may otherwise be caused by ink due to relative displacement between the ink saturated members 19*a* of platen 19 and paper 18, especially when the paper is transported for changing the line of the paper 18 to be printed. It is not always necessary to make null the relative speed between paper 18 and platen 19, which should alternatively be minimized as much as possible to provide the same effect.

When starting the printing operation on a new line with the printing color unchanged, it is necessary that, after the paper 18 has been transported to change the line, the platen 19 is rotated back in the clockwise direction CW (by rotating the motor shaft 2*a* in the counterclockwise direction CCW) in an amount corresponding to the preceeding counterclockwise rotation thereof. In this operation, there is little possibility of paper contamination, as the paper 18 remains standstill while the platen 19 is simply rotated around a predetermined center axis.

Next, the color changing operation is carried out by rotating the motor shaft 2*a* in the counterclockwise direction CCW. Thus, the platen 19 is rotated in the clockwise direction CW through pulley 3, belt 24, pulley 29, square shaft 22 and gears 26, 20, to thereby select a desired one of differently colored members 19*a*.

In this case, the first unit 10 is rotated in the counterclockwise direction CCW together with the motor shaft 2*a*, but the second unit 11 is kept standstill to prevent the paper 18 from running. Consequently, there will arise no risk of paper 18 being contaminated by ink saturated members 19*a* of platen 19.

While the invention has been described in conjunction with a specific embodiment thereof, it is to be readily understood that many different variations and modifications may be made without departing from spirit and scope of the invention.

What we claim is:

1. A printer having a rotary platen having a plurality of members saturated with different color inks provided on a periphery thereof, a printing head arranged opposite to said platen so as to cooperate with said platen to apply an ink of a specific color to a printing paper adapted to pass therebetween, first means 22, 26, 20 for rotating said platen, second means 13, 17, 32 for transporting said printing paper relative to said platen and said printing head, said printer comprising a single reversible motor electrically energized to rotate in one and the opposite directions; first transmission means 3, 24, 39 operatively connecting said first means to said single reversible motor irrespective of the rotational direction of the motor; and second transmission means operatively connecting said second means to said single reversible motor, said second transmission means 4, 8, 9, 12, 14, 31, 30 including a one-way clutch, said clutch being operative to transmit the rotation of said single reversible motor to said second means when said motor is rotated in one direction, said clutch remiaining inoperative failing to transmit the rotation of said single reversible motor to said second means when the motor is rotated in the opposite direction, said second transmission means including an intermediate gear 8 provided between said single reversible motor and said one-way clutch, said intermediate gear having gear teeth provided therearound, further comprising a first rotating member operatively connected to said motor and normally rotated in one or the other direction together with said motor, a second rotating member operatively connected to said second means for transporting said printing paper relative to said platen and said printing head and coupling means for operatively connecting said first rotating member to said second rotating member when said motor is rotated in said one direction to thereby transmit the rotation of said motor to said second means, said coupling means disconnecting said first rotation member from said second rotating member when said motor is rotated in said opposite direction, so as to rotate said platen with respect to said printing paper while the latter is kept standstill.

2. The printer according to claim 1 wherein said first transmission means includes a first group of gears and said second transmission means a second group of gears, said first and second groups of gears being designed to have a same transmission ratio.

* * * * *